US008714405B2

(12) United States Patent
Farnsworth et al.

(10) Patent No.: US 8,714,405 B2
(45) Date of Patent: May 6, 2014

(54) DEVICE FOR STAGING AND DISPENSING TABLETS USEFUL IN SYSTEM AND METHOD FOR DISPENSING PRESCRIPTIONS

(75) Inventors: Bryan Patrick Farnsworth, Wake Forest, NC (US); Edward J. Karwacki, Jr., Garner, NC (US); Jennifer Ann Mauger, Durham, NC (US); David Alan Calderwood, Chapel Hill, NC (US)

(73) Assignee: Parata Systems, LLC, Durham, NC (US)

( * ) Notice: Subject to any disclaimer, the term of this patent is extended or adjusted under 35 U.S.C. 154(b) by 934 days.

(21) Appl. No.: 12/186,025

(22) Filed: Aug. 5, 2008

(65) Prior Publication Data

US 2009/0039097 A1 Feb. 12, 2009

Related U.S. Application Data

(60) Provisional application No. 60/955,056, filed on Aug. 10, 2007.

(51) Int. Cl.
*G07F 11/00* (2006.01)

(52) U.S. Cl.
USPC ..... 221/10; 221/278

(58) Field of Classification Search
USPC ..... 221/1, 151, 152, 154, 174, 191, 194, 221/200, 204, 208, 224, 246, 278
See application file for complete search history.

(56) References Cited

U.S. PATENT DOCUMENTS

| | | | | |
|---|---|---|---|---|
| 1,157,709 | A | | 10/1915 | Maher |
| 1,445,078 | A | | 2/1923 | Freeman |
| 1,718,084 | A | | 6/1929 | Segelken |
| 1,783,423 | A | | 12/1930 | Harper |
| 2,044,326 | A | | 6/1936 | Pickell |
| 2,150,753 | A | | 3/1939 | Weinstein |
| 3,089,620 | A | | 5/1963 | Green et al. |
| 3,320,879 | A | | 5/1967 | Edwards |
| 3,730,388 | A | * | 5/1973 | Bender ..... 221/68 |
| 3,746,211 | A | * | 7/1973 | Burgess, Jr. ..... 221/7 |
| 3,779,428 | A | | 12/1973 | Bauman |
| 3,823,844 | A | * | 7/1974 | Linkemer et al. ..... 221/13 |
| 4,049,157 | A | | 9/1977 | Carson |

(Continued)

OTHER PUBLICATIONS

Baker Cells® Brochure—Dispensing Technology: Industry Standard for Efficiency in Automated Prescription Filling, McKesson Pharmacy Systems and Automation, http://www.mckessonaps.com.

*Primary Examiner* — Gene Crawford
*Assistant Examiner* — Kelvin L Randall, Jr.
(74) *Attorney, Agent, or Firm* — Myers Bigel Sibley & Sajovec, P.A.

(57) ABSTRACT

A chute assembly for an object dispensing apparatus includes: a chute configured at a first end to attach to and convey objects from an object dispenser; a funnel having an inlet that merges with a second end of the chute and an outlet; a door attached to the funnel, the door being movable between a closed position, in which the door covers the funnel outlet and prevents access to objects within the funnel, and an open position, in which the door does not cover the funnel outlet and allows access to objects within the funnel; an object agitation unit configured to agitate objects in the funnel to prevent such objects from jamming in the funnel; and a locking unit associated with the door that prevents the door from moving to the open position without authorization.

3 Claims, 10 Drawing Sheets

(56) References Cited

U.S. PATENT DOCUMENTS

| | | | | |
|---|---|---|---|---|
| 4,384,662 | A | 5/1983 | Boudin et al. | |
| 4,466,559 | A | 8/1984 | Loader | |
| 4,619,379 | A | 10/1986 | Biehl | |
| 5,317,645 | A | 5/1994 | Perozek et al. | |
| 5,473,703 | A | 12/1995 | Smith | |
| 5,647,508 | A | 7/1997 | Ronci et al. | |
| 5,667,108 | A | 9/1997 | Braun et al. | |
| 5,765,606 | A | 6/1998 | Takemasa et al. | |
| 5,884,806 | A | 3/1999 | Boyer et al. | |
| 5,907,493 | A | 5/1999 | Boyer et al. | |
| 5,958,494 | A * | 9/1999 | Tidland et al. | 426/466 |
| 6,138,878 | A | 10/2000 | Savage et al. | |
| 6,161,721 | A | 12/2000 | Kudera et al. | |
| 6,370,215 | B1 | 4/2002 | Pinto et al. | |
| 6,481,180 | B1 | 11/2002 | Takahashi et al. | |
| 6,497,339 | B1 | 12/2002 | Geltser et al. | |
| 6,581,355 | B1 | 6/2003 | Yuyama et al. | |
| 6,595,384 | B2 | 7/2003 | Takahashi | |
| 6,644,504 | B2 | 11/2003 | Yuyama et al. | |
| 6,659,304 | B2 | 12/2003 | Geltser et al. | |
| 7,014,063 | B2 | 3/2006 | Shows et al. | |
| 7,073,544 | B2 | 7/2006 | Geltser et al. | |
| 7,178,697 | B2 | 2/2007 | Brundick et al. | |
| 7,263,411 | B2 | 8/2007 | Shows et al. | |
| 7,334,700 | B2 | 2/2008 | Hatsuno et al. | |
| RE40,453 | E * | 8/2008 | Lasher et al. | 53/411 |
| 7,412,302 | B2 | 8/2008 | Cobb et al. | |
| 7,770,355 | B2 | 8/2010 | Inamura | |
| 7,853,355 | B1 * | 12/2010 | Willemse et al. | 700/243 |
| 2004/0159669 | A1 * | 8/2004 | Pollard et al. | 221/278 |
| 2004/0222232 | A1 * | 11/2004 | Jespersen et al. | 221/1 |
| 2006/0006190 | A1 * | 1/2006 | Janet et al. | 221/211 |
| 2008/0264978 | A1 * | 10/2008 | Rode et al. | 222/413 |
| 2010/0282770 | A1 * | 11/2010 | Mendes et al. | 221/204 |

* cited by examiner

DEVICE FOR STAGING AND DISPENSING TABLETS USEFUL IN SYSTEM AND METHOD FOR DISPENSING PRESCRIPTIONS

RELATED APPLICATIONS

This application claims priority from U.S. Provisional Patent Application No. 60/955,056, filed Aug. 10, 2007 for Device for Staging and Dispensing Tablets Useful in System and Method for Dispensing Prescriptions, the disclosure of which is hereby incorporated herein in its entirety.

FIELD OF THE INVENTION

The present invention is directed generally to the dispensing of prescriptions of pharmaceuticals, and more specifically is directed to the automated dispensing of pharmaceuticals.

BACKGROUND OF THE INVENTION

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate all or portions of the pharmacy environment. Different exemplary approaches are shown in U.S. Pat. Nos. 6,006,946; 6,036,812 and 6,176,392 to Williams et al. and in U.S. Pat. No. 7,014,063 to Shows et al. The Williams system conveys a bin with tablets to a counter and a vial to the counter. The counter dispenses tablets to the vial. Once the tablets have been dispensed, the system returns the bin to its original location and conveys the vial to an output device. Tablets may be counted and dispensed with any number of counting devices. Shows et al. discloses a system that includes multiple drawers, each of which includes a plurality of dispensing devices that dispense tablets into a dispensing chute. The dispensing devices may be of the so-called "Baker Cell" configuration (see U.S. Pat. No. 3,368,713 to Hurst et al.), in which the tablets are mechanically singulated and counted prior to dispensing into the dispensing chute. The tablets are stored in the dispensing chute until such time as a pharmacist or technician dispenses the tablets from the chute into a pharmaceutical vial.

Although either of these particular systems can provide some automated steps to pharmaceutical dispensing, certain of the operations may be improved. In particular, tablets stored in the chute can jam, thereby rendering their dispensing into a waiting vial more difficult. Also, in some cases a pharmacy may desire some restrictions on the dispensing of the tablets from the chute.

SUMMARY OF THE INVENTION

As a first aspect, embodiments of the present invention are directed to a chute assembly for an object dispensing apparatus. The apparatus comprises: a chute configured at a first end to attach to and convey objects from an object dispenser; a funnel having an inlet that merges with a second end of the chute and an outlet; a door attached to the funnel, the door being movable between a closed position, in which the door covers the funnel outlet and prevents access to objects within the funnel, and an open position, in which the door does not cover the funnel outlet and allows access to objects within the funnel; an object agitation unit configured to agitate objects in the funnel to prevent such objects from jamming in the funnel; and a locking unit associated with the door that prevents the door from moving to the open position without authorization. This configuration can prevent the objects from jamming, thereby facilitating their dispensing from the funnel, and can prevent the unauthorized or incorrect dispensing of objects.

As a second aspect, embodiments of the present invention are directed to a chute assembly for an object dispensing apparatus, comprising: a chute configured at a first end to attach to and convey objects from an object dispenser; a funnel having an inlet that merges with a second end of the chute and an outlet; a door attached to the funnel, the door being movable between a closed position, in which the door covers the funnel outlet and prevents access to objects within the funnel, and an open position, in which the door does not cover the funnel outlet and allows access to objects within the funnel; and an object agitation unit configured to agitate objects in the funnel to prevent such objects from jamming in the funnel, the object agitation unit comprising a plurality of air jets positioned in the funnel.

As a third aspect, embodiments of the present invention are directed to a method of dispensing objects contained in a bulk container. The method comprises the steps of: releasing a predetermined number of objects from the bulk container into a chute; directing an air jet at the objects to agitate the objects; and releasing the objects into a receptacle. In some embodiments, the objects are pharmaceutical tablets, and the receptacle is a pharmaceutical vial.

As a fourth aspect, embodiments of the present invention are directed to a method of dispensing objects contained in a bulk container, comprising the steps of: releasing a predetermined number of objects from the bulk container into a chute; agitating the objects; authorizing the release of the objects; responsive to the authorizing step, unlocking a locking unit that prevents the release of the objects; and releasing the objects into a receptacle after the authorizing and unlocking steps. In certain embodiments, the authorizing step can comprise the scanning of an ID badge; in other embodiments, the authorizing step can comprise the scanning of the label of a pharmaceutical vial.

DETAILED DESCRIPTION OF EMBODIMENTS OF THE INVENTION

Figure 1:
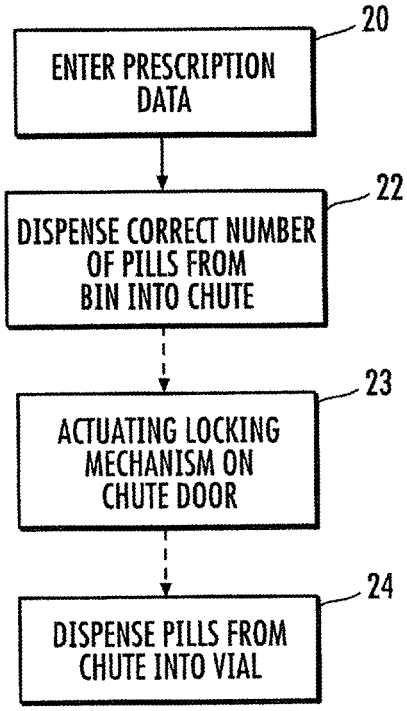
FIG. 1 is a flow chart of operations according to embodiments of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As described above, the invention relates generally to a system and process for dispensing pharmaceuticals. An exemplary process is described generally with reference to FIG. 1. The process begins with the entry of prescription data (Box 20). The correct number of pills to fill the prescription is dispensed from a bin containing a bulk supply of those pills into an attached chute (Box 22). The pills are then dispensed from the chute into a vial (Box 24), wherein the vial is typically held by pharmacy personnel. Optionally, the process may include a step in which a door of the chute is unlocked to release the pills from the chute (Box 23). Typically the unlocking of the chute occurs in response to an authorization or confirmation step, which may be initiated by the scanning of a user ID or a code on the vial.

Figure 2:
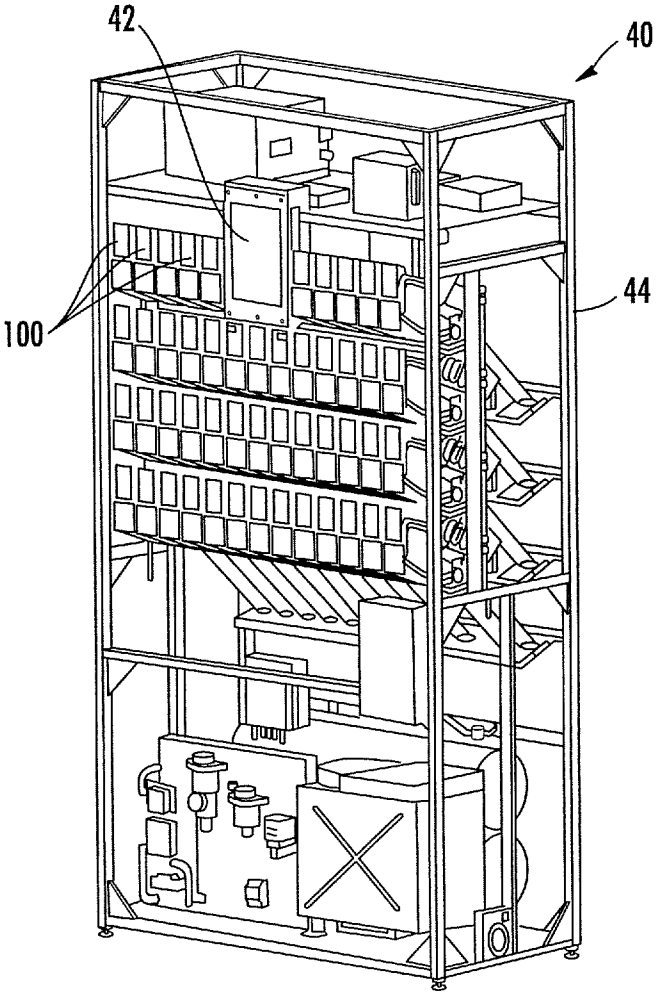
FIG. 2 is a perspective view of the replenishing side (illustrating the bins) of a pharmaceutical dispensing system according to embodiments of the present invention.
Figure 3:
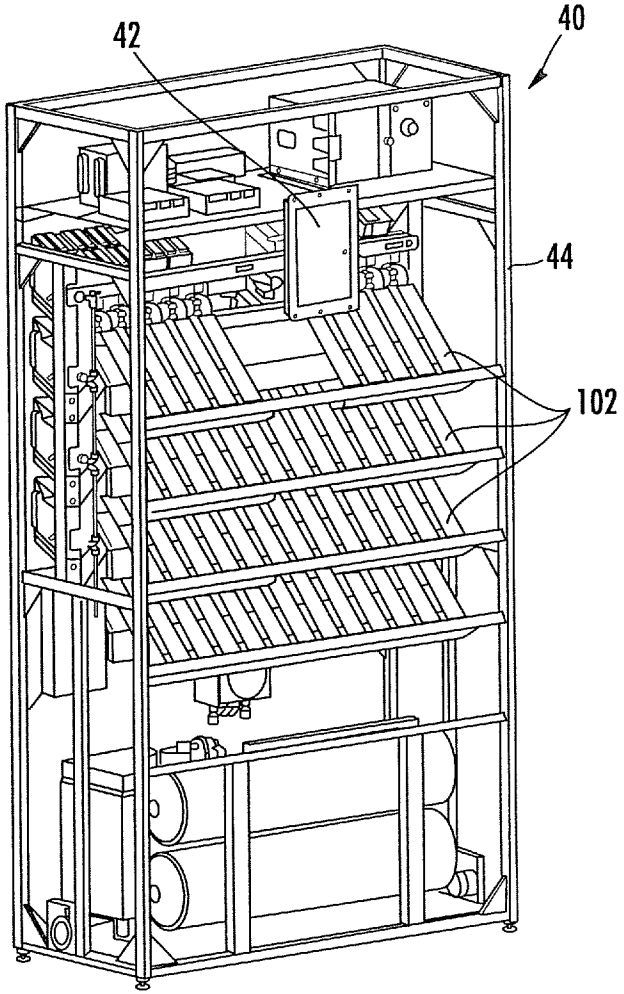
FIG. 3 is a reverse perspective view of the dispensing side (illustrating the chutes) of the pharmaceuticals dispensing system of FIG. 2.
Figure 4:
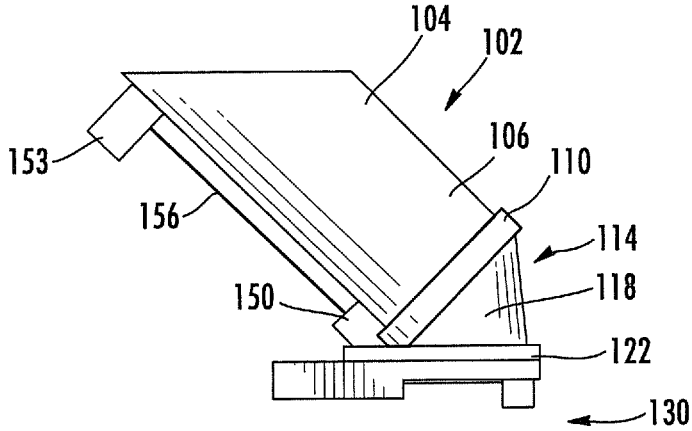
FIG. 4 is an enlarged side view of a dispensing chute, funnel and door assembly of the system of FIG. 2.
Figure 5:
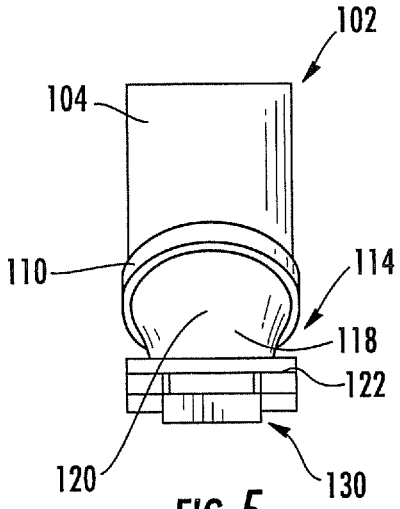
FIG. 5 is a front view of the components of FIG. 4.

A system that can carry out this process is illustrated in FIGS. 2 and 3 and designated broadly therein at 40. The system 40 includes a support frame 44 for the mounting of its various components. The system 40 generally includes as operative stations a controller (represented herein by two graphics user interface monitors 42), a number of tablet dispensing bins 100, and a number of chute assemblies 102, each associated with a respective bin 100.

In the illustrated embodiment, the bins 100 are configured to singulate, count and dispense pills through an air agitation technique. The air agitation technique is described in some detail in, for example, U.S. Pat. No. 6,971,541 to Williams et al., supra, and U.S. Pat. No. 7,344,049, and need not be described in detail herein. Those skilled in this art will appreciate that other pill dispensing apparatus, including those that rely on mechanical singulating action (see, e.g., U.S. Pat. No. 7,014,063), may also be employed.

Turning now to FIGS. 4-9, the lower end of an exemplary chute assembly 102 is illustrated therein. The chute assembly 102 includes a chute 104, a funnel 114, a door unit 130, and a locking unit 150. These components are discussed in greater detail below.

The chute 104 is hollow and is connected at its upper end to the outlet of a bin 100 (seen best in FIG. 3). The chute 104 slopes away from the bin 100; typically the angle of slope is between about 30 and 60 degrees relative to horizontal, which enables pills dispensed into the chute 104 from the bin 100 to slide to the lower end of the chute 104. The lower end 106 of the chute 104 is connected to a connecting ring 110 (see FIG. 4).

The chute 104 can be formed of any suitable material, but is typically formed of a polymeric material such as polycarbonate. In some embodiments, the chute 104 is completely enclosed as illustrated herein, but need not be in other embodiments.

A common issue encountered in these systems is the need to transfer a static volume of medicament from a large holding area (in the chute) to a smaller container (the vial). Typically a funnel is used but often objects will jam in the funnel preventing delivery of some or all of the medicament into the vial. However, the funnel 114, as described below, can address this issue.

Referring again to FIGS. 4-9, the funnel 114 is attached to the lower end of the chute assembly 102 via the connecting ring 110. The funnel 114 has generally convex sidewalls 118, with convex inner surfaces 119 (see FIG. 7), although the front portion 120 is relatively straight and substantially vertical (see FIG. 9). Together, the side walls 118 and front wall 120 define a cavity 116 (FIG. 7). The funnel 114 also includes a base 122 at its lower end that includes an opening 123 below the cavity 116 (FIGS. 7 and 9). The funnel 114 is configured such that its inlet 115 is oriented at a 45° angle to the opening 123 (see FIGS. 7-9).

Figure 8:
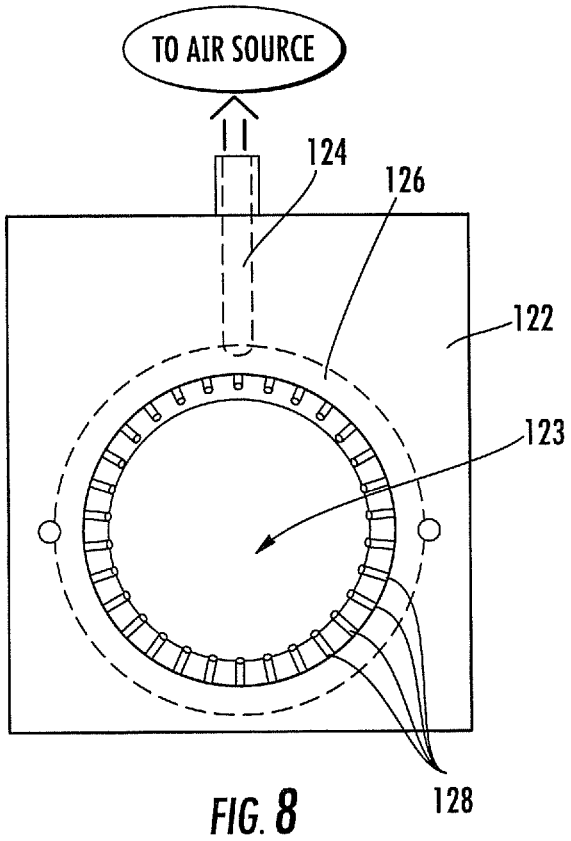
FIG. 8 is a bottom view of the funnel of FIG. 4.
Figure 9:
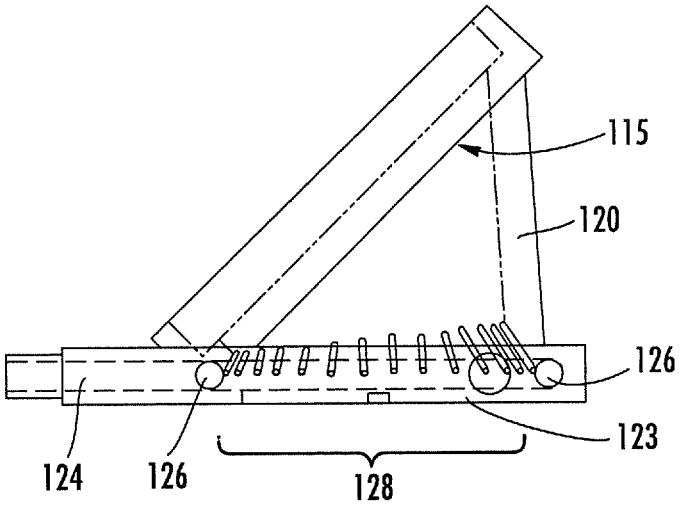
FIG. 9 is a side view of the funnel and connecting ring of FIG. 4.

Referring now to FIGS. 8 and 9, the base 122 includes a bore 124 that extends from the rear end of the base 122 to a circular manifold 126. The bore 124 is configured to be attached to a high pressure air source (not shown). The air source can be common to that used to agitate pills in the bins 100, or can be a separate air source. Air jets 128 extend upwardly and radially inwardly from the manifold 126 into the cavity 116.

The funnel 114 can be formed of any suitable material, but in some embodiments is formed of a polymeric material. The funnel 114 may be a separate component as shown, or may be formed integrally with the chute 104 (i.e., the connecting ring 110 may be omitted).

Referring now to FIGS. 6 and 10-12, the door unit 130 includes a door frame 132 and a door 140. The door frame 132 includes a floor 133 that is lined by walls 134, such that a pocket 135 is formed. A recess 134*a* is present in a rear one of the walls 134. A channel 136 is present in the floor 133 and extends from the recess 134*a* to the opposite edge of the floor 133. A cantilevered post 139 is fixed to one end of the channel 136 and extends to the opposite end. A spring 138 encircles the post 139.

Figure 10:
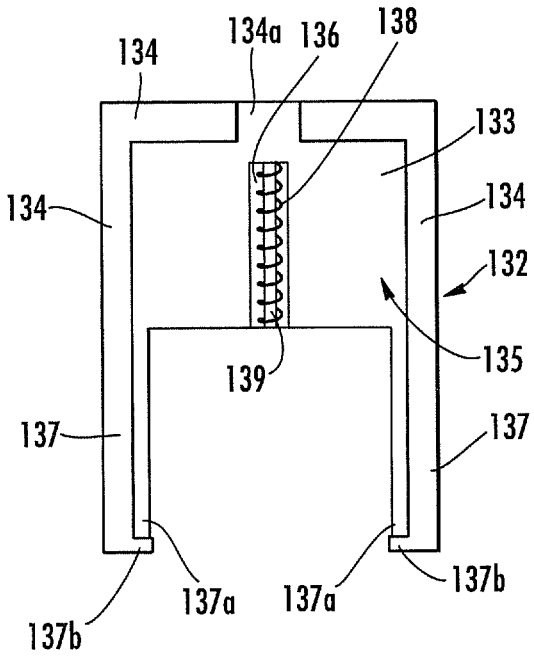
FIG. 10 is a top view of the door frame of the door assembly of FIG. 4.

Still referring to FIG. 10, two legs 137 extend away from the floor 133 coextensive with the side walls 134. Ledges 137*a* extend inwardly from the legs 137 and are coplanar with the floor 133. Nubs 137*b* extend inwardly from the free ends of the legs 137.

Figure 11:
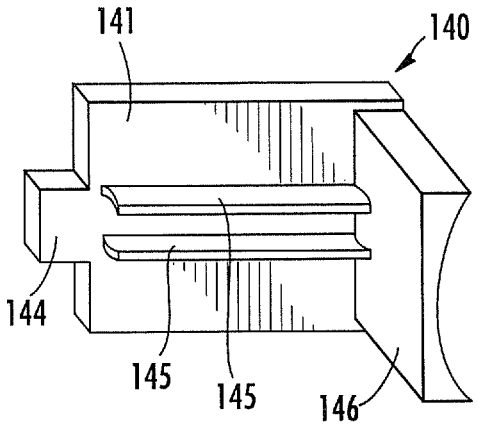
FIG. 11 is a bottom perspective view of the door of the door assembly of FIG. 4.
Figure 12:
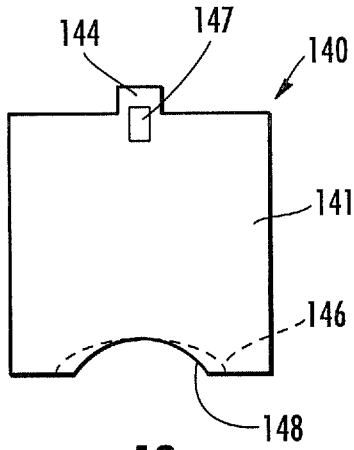
FIG. 12 is a top view of the door of FIG. 11.

Referring now to FIGS. 11 and 12, the door 140 includes a main panel 141 that has a tab 144 extending from one end. A recess 147 is present in the tab 144. Two curved rails 145 project downwardly from the lower surface of the door 140 and extend from the tab 144 to an arcuate bearing member 146, which also extends downwardly from the lower surface of the door 140. An upper bearing ledge 148 having a slightly smaller radius of curvature than the bearing member 146 is positioned above the bearing member 146.

Figure 13:
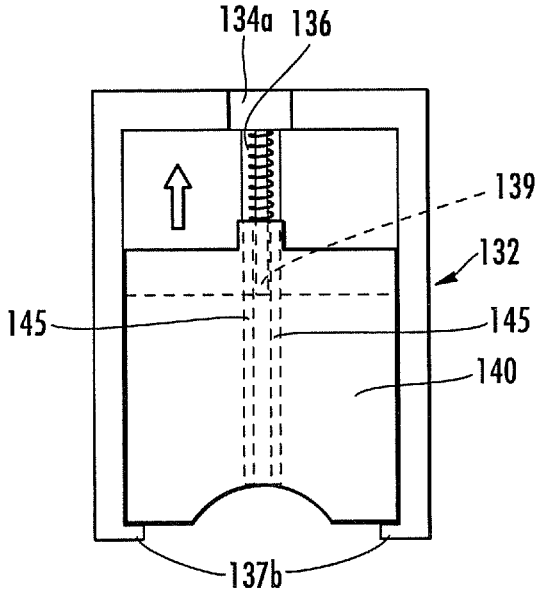
FIG. 13 is a top view of the door and door frame of the door assembly of FIG. 4.

Referring now to FIG. 13, the door 140 fits within the door frame 132, with the side edges of the door 140 resting on the ledges 137*a* and between the legs 137 and walls 134 of the door frame 132. The rails 145 are received in the channel 136 and capture the post 139. The spring 138, which is in compression, biases the rails 145 away from the recess 134*a*, such that the door 140 contacts and is maintained in position by the nubs 137*b*.

The door 140 and door frame 132 may be formed of any suitable material, but in some embodiments are formed of polymeric materials, such as polycarbonate.

Figure 6:
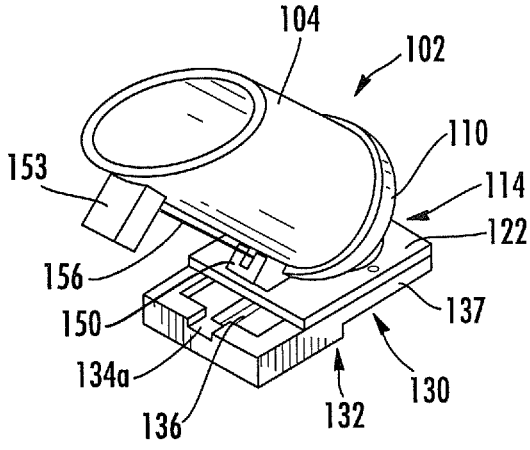
FIG. 6 is a rear, fragmentary, perspective view of the components of FIG. 4.
Figure 7:
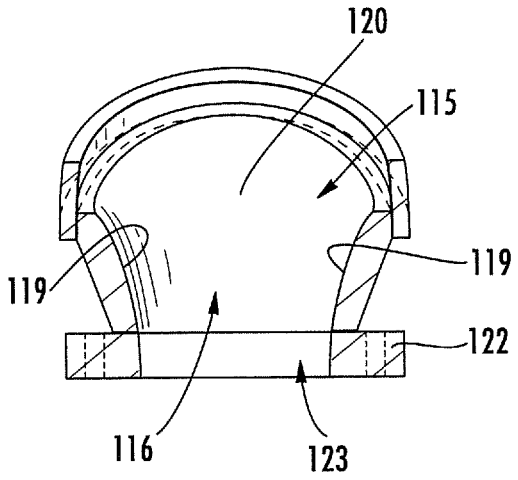
FIG. 7 is an enlarged section view of the funnel and connecting ring of FIG. 6.
Figure 14:
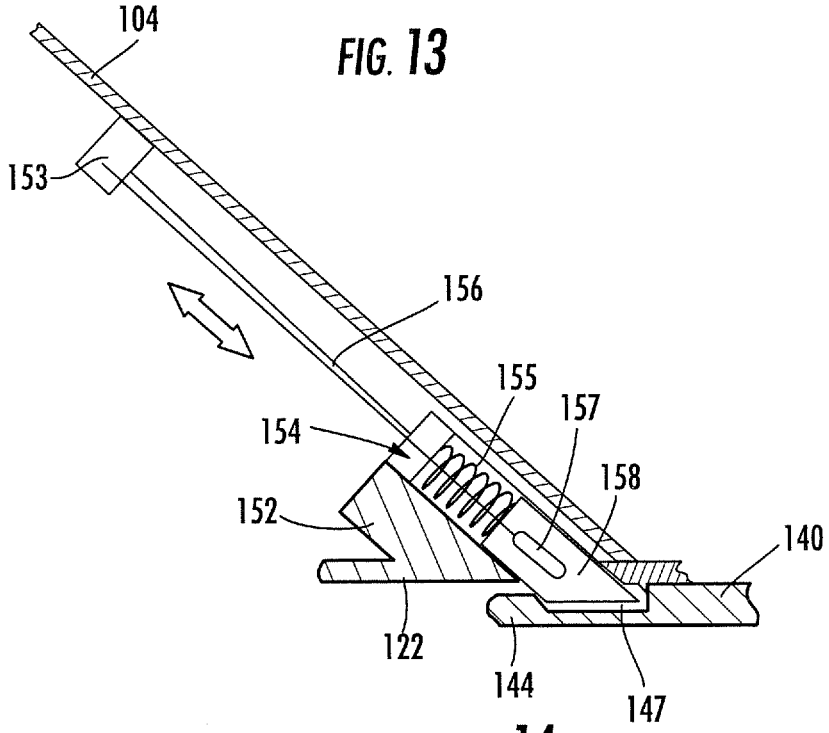
FIG. 14 is a greatly enlarged section view of the locking system of the components of FIG. 4.

Referring to FIGS. 6 and 14, the locking unit 150, which is mounted to the rear portion of the base 122, includes a block 152 in which is cut a slot 154. An engagement member 158 resides in the slot 154. A wire 156 formed from a shape memory alloy (i.e., a material that shrinks upon heating) is looped through a slot 157 in the engagement member 158 and is also looped through a bracket 153 that is mounted on the chute 104. The wire 156 is electrically connected to a voltage source (not shown). A spring 155 is present in the slot 154 and biases the engagement member 158 toward the door 140. Thus, as can be seen in FIG. 13, the engagement member 158 engages the recess 147 in the tab 144 of the door 140.

Figure 15:
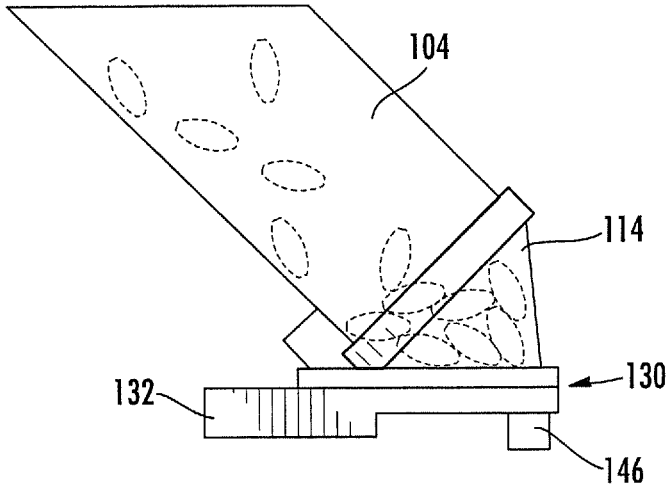
FIG. 15 is a side view of the chute assembly of FIG. 4 showing pills being dispensed into the funnel.

In operation, pharmacy personnel enters prescription information, which is processed by the controller 42. The controller 42 signals a bin 100 to dispense a specific quantity of pills. The pills exit the bin 100 and travel down the chute 104 and into the funnel 114 (FIG. 15). At this point, the pills are in position to be dispensed from the funnel 114 into a vial.

When a pharmacy operator is prepared to discharge the pills from the funnel 114, he first actuates the locking unit 150. This can be performed in multiple ways; for example, the operator may scan an ID badge that indicates that the operator has authority to receive dispensed pills or may scan the label for the prescription being filled. Actuation of the locking unit 150 energizes the voltage source connected to the wire 156 (see FIG. 14). Application of a voltage on the wire 156 causes it to contract (this behavior is characteristic of shape memory alloys). Contraction of the wire 156 draws the engagement member 158 upwardly in the slot 154 and away from the door 140 (this movement is resisted by the spring 155). Once the engagement member 158 has cleared the door 140, the door 140 is free to move.

Figure 16:
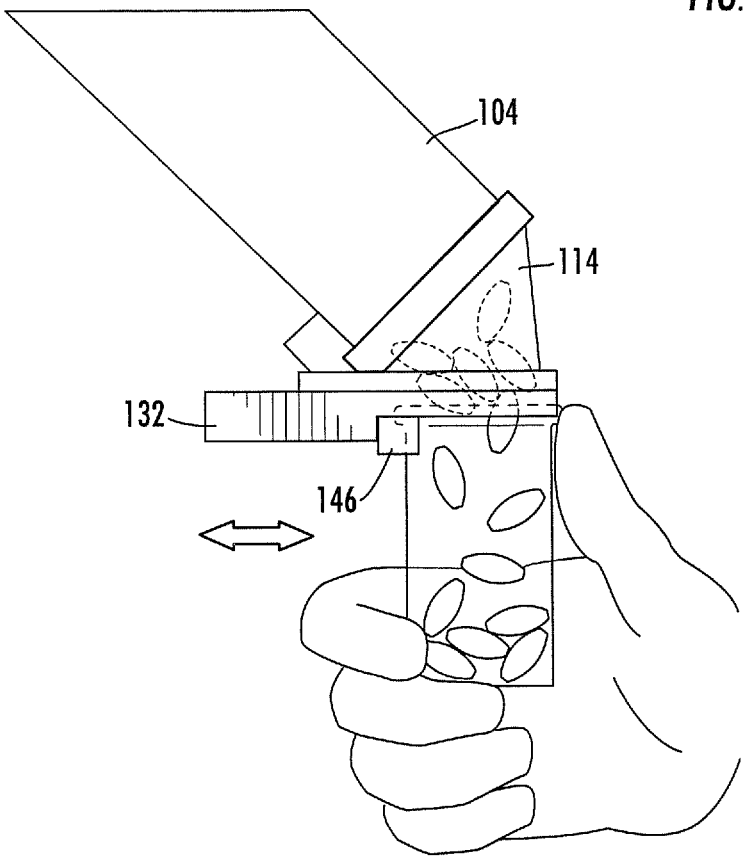
FIG. 16 is a side view of the chute assembly of FIG. 4 showing the dispensing of pills from the funnel into a vial.

The pharmacy operator then selects the vial of the proper size and positions it under the door 140 against either the bearing member 146 or the upper bearing ledge 148 (depending on the size of the vial). Application of a horizontal force against the bearing member 146 or the upper bearing ledge 148 causes the door 140 to slide relative to the door frame 132 (see FIG. 16). Movement of the door 140 is resisted by the spring 138. Once the door 140 slides past the opening 123, pills are free to exit the funnel 114 and drop into the vial. Removal of the vial allows the door 140 to return to its original position (assisted by the spring 138). It should be noted that dispensing of the pills can be accomplished by the operator with just one hand.

In some embodiments, movement of the door 140 causes the air source to provide air to the air jets 128 through the bore 124 and manifold 126, which agitates the pills to prevent them from jamming and to facilitate their exit from the funnel 114. In other embodiments, another mechanism or prompt, such as a predetermined duration from the scanning of an ID badge or the detection of jamming by the system, may cause the air source to provide air.

Also, the convex shape of the walls of the funnel 114 can minimize the area of the funnel 114 in contact with the pills, which can help to prevent the pills from sticking on the walls and encouraging jamming of the funnel 114. Thus, the funnel 114 enables the path of the pills to veer 45 degrees from the chute 104 to the opening 123 in the base 122 for dispensing into the vial, and to do so without jamming.

Figure 17:
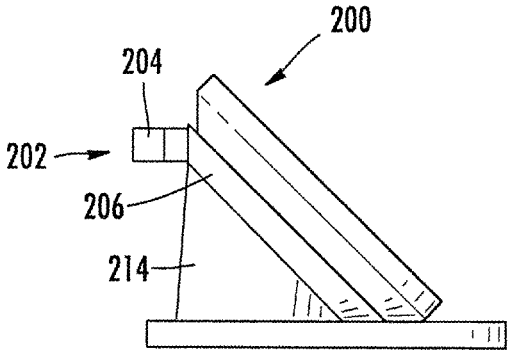
FIG. 17 is a side view of a connecting ring, funnel and door assembly according to alternative embodiments of the present invention.

Referring now to FIG. 17, another funnel assembly, designated broadly at 200, is illustrated therein. The funnel assembly 200 includes as its agitation unit a vibrating assembly 202 comprising a vibrating unit 204 and a ring 206 that circumscribes the funnel 214. The vibrating unit 204 can be any vibrating unit known to those skilled in this art to be suitable for inducing vibration (such as a rotating eccentric weight unit similar to those often employed in mobile telephones). Vibration of the vibrating unit 204 agitates pills residing in the funnel 214 to prevent jamming and facilitate conveyance of pills to a vial positioned below the funnel 214.

Figure 18:
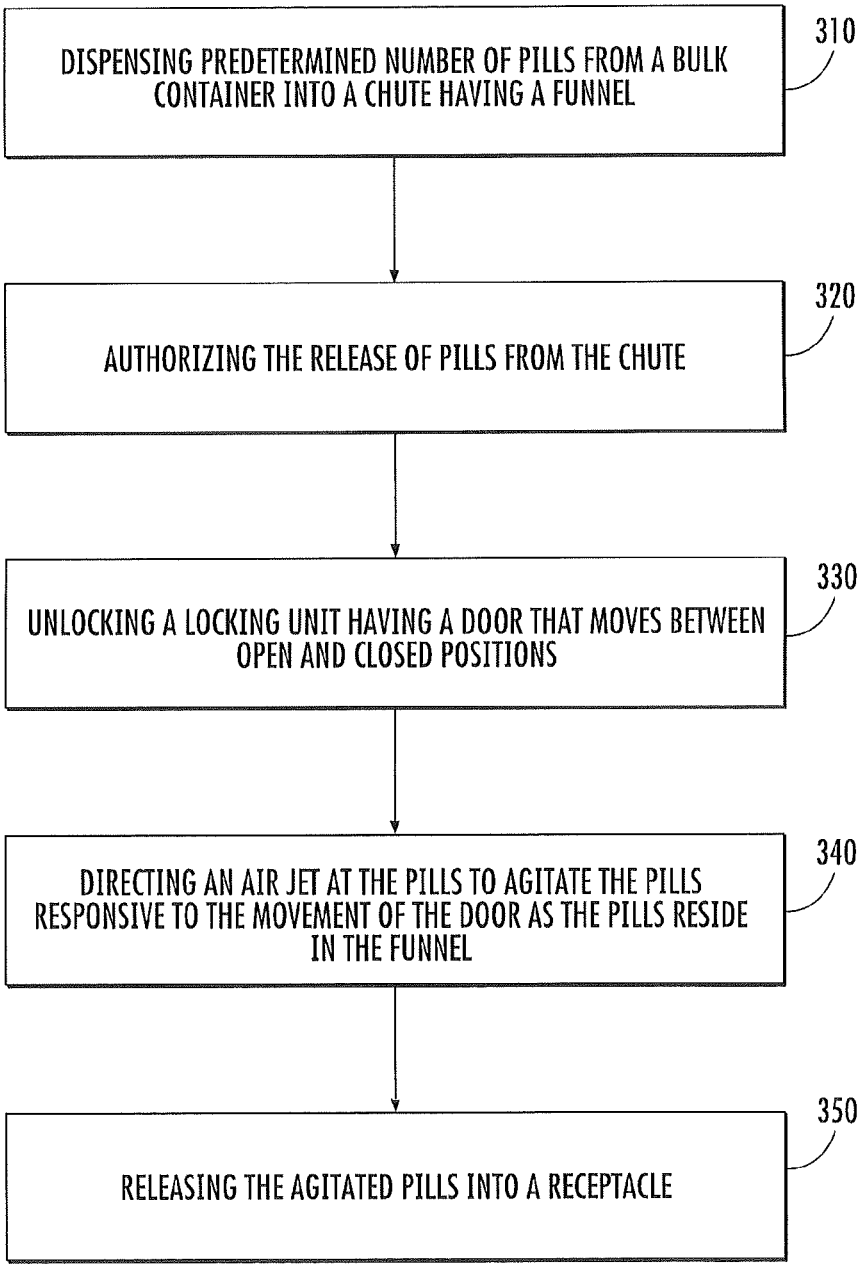
FIG. 18 is a flow chart illustrating exemplary operations according to embodiments of the invention.

Referring now to FIG. 18, an exemplary method according to embodiments of the present invention are illustrated therein. The method includes the steps of: (a) releasing a predetermined number of pills from the bulk container into a chute, wherein a funnel is positioned at one end of the chute (Block 310); authorizing the release of the pills from the chute (Block 320); unlocking a locking unit that prevents the release of the pills, wherein the locking unit includes a door that moves between open and closed positions (Block 330); directing an air jet at the pills to agitate the pills as they reside in the funnel (Block 340), wherein the directing of the air jet is responsive to the movement of the door; and releasing the agitated pills into a receptacle (Block 350).

Those skilled in this art will appreciate that objects other than pharmaceutical pills or tablets may be dispensed with the chute assembly of the present invention. For example, machine parts and components, foodstuffs, vending machine items, and the like may be dispensed.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A method of dispensing objects contained in a bulk container, comprising the steps of:

releasing a predetermined number of objects from the bulk container into a chute, wherein a funnel is positioned at one end of the chute;

directing an air jet at the objects to agitate the objects as they reside in the funnel; and releasing the agitated objects from the funnel into a receptacle;

wherein the objects are pharmaceutical tablets, and the receptacle is a pharmaceutical vial; and further comprising the steps of authorizing the release of the objects prior to the releasing step and unlocking a locking unit that prevents the release of the objects, the unlocking step being performed in response to the authorizing step;

wherein the locking unit includes a door that moves between open and closed positions, and wherein the directing step occurs responsive to movement of the door from the closed position to the open position.

2. The method defined in claim 1, wherein the authorizing step comprises scanning an ID badge.

3. The method defined in claim 1, wherein the authorization step comprises scanning a label on the pharmaceutical vial.

* * * * *